US007196717B2

(12) United States Patent
Mori et al.

(10) Patent No.: US 7,196,717 B2
(45) Date of Patent: Mar. 27, 2007

(54) IMAGE FORMING APPARATUS, CONTROL METHOD THEREFOR, AND PROGRAM FOR IMPLEMENTING THE CONTROL METHOD

(75) Inventors: Akihito Mori, Toride (JP); Hajime Kaji, Abiko (JP); Naoto Yamada, Kawasaki (JP); Yoshitaka Yamazaki, Toride (JP); Junichi Noguchi, Toride (JP); Hajime Motoyama, Moriya (JP); Satoshi Ogawara, Abiko (JP); Yushi Oka, Abiko (JP); Takayuki Kawakami, Nagoya (JP)

(73) Assignee: Canon Kabushiki Kaisha (JP)

( * ) Notice: Subject to any disclaimer, the term of this patent is extended or adjusted under 35 U.S.C. 154(b) by 256 days.

(21) Appl. No.: 11/057,869

(22) Filed: Feb. 14, 2005

(65) Prior Publication Data

US 2005/0190254 A1 Sep. 1, 2005

(30) Foreign Application Priority Data

Feb. 17, 2004 (JP) ..... 2004-040017

(51) Int. Cl.
*B41J 2/47* (2006.01)

(52) U.S. Cl. ..... 347/252; 347/253

(58) Field of Classification Search ..... 347/236–240, 347/246–254

See application file for complete search history.

(56) References Cited

U.S. PATENT DOCUMENTS 4,914,459 A * 4/1990 Mama et al. ..... 347/133
5,153,609 A * 10/1992 Ando et al. ..... 347/129
5,379,126 A * 1/1995 Seto et al. ..... 358/3.06
5,574,563 A * 11/1996 Hayashi et al. ..... 358/296
2004/0189779 A1* 9/2004 Nakahanada et al. ..... 347/118
2005/0175365 A1* 8/2005 Gomi ..... 399/49

FOREIGN PATENT DOCUMENTS

JP 5-145154 A 6/1993
JP 09319163 A * 12/1997
JP 2000-339736 A 12/2000

* cited by examiner

*Primary Examiner*—Hai Pham
(74) *Attorney, Agent, or Firm*—Rossi, Kimms & McDowell LLP

(57) ABSTRACT

An image forming apparatus which is capable of eliminating density irregularities of an image formed caused by potential irregularities of the photosensitive member when the drum is irradiated by a beam of constant luminous intensity. A laser driver irradiates a beam modulated based on an image signal onto a photosensitive member. A current controller variably controls a driving current for driving the laser driver. A PWM pulse width converter modulates a pulse width of the beam based on the image signal. A potential sensor measures the potential of the photosensitive member after the photosensitive member is irradiated by a beam having a predetermined luminous intensity. A selector causes the current controller to correct the driving current based on low frequency components of irregularities of the potential and changes a modulation coefficient used for modulating the pulse width based on high frequency components of the irregularities of the potential.

14 Claims, 8 Drawing Sheets

IMAGE FORMING APPARATUS, CONTROL METHOD THEREFOR, AND PROGRAM FOR IMPLEMENTING THE CONTROL METHOD

BACKGROUND OF THE INVENTION

1. Field of the Invention

The present invention relates to an image forming apparatus, a method of controlling the apparatus and a program for implementing the method, and more particularly to a technique of controlling a beam which is pulse width modulated based on an image signal and irradiated onto a photosensitive member to form an electrostatic latent image thereon.

2. Description of the Related Art

In a conventional image forming apparatus, such as an electrophotographic printer or a copying machine, generally, an electrostatic latent image is formed on a photosensitive member by irradiating a beam (laser beam), which is modulated based on an image signal, onto the photosensitive member, and this electrostatic latent image is developed by toner.

A pulse width modulation (PWM) method is known as a laser driving method, in which the duration of irradiation of a laser beam per unit pixel is modulated according to the image signal while the luminous intensity of the laser beam (the amount of laser beam) is maintained constant.

In the PWM method, the luminous intensity of the laser beam has to be maintained constant. However, a laser emitting device that emits the laser beam has a temperature characteristic such that the higher the temperature of the laser emitting device, the greater the amount of driving current required to maintain the luminous intensity of the laser beam constant. Moreover, the laser emitting device itself generates heat, and therefore the luminous intensity cannot be maintained constant merely by applying a constant amount of current to the laser emitting device. Thus, even if an image is formed by a PWM signal corresponding to an image signal having a uniform density, the resulting image has a non-uniform density.

To eliminate such non-uniform density of an image, means for adjusting the luminous intensity of the laser beam to a constant value has been proposed (see, for example, Japanese Laid-Open Patent Publication (Kokai) No. H05-145154 and Japanese Laid-Open Patent Publication (Kokai) No. 2000-339736).

An image forming apparatus having the means for adjusting the luminous intensity of the laser beam to a constant value includes, for example, a laser chip 43 comprised of a laser emitting device 43A, and a photodiode (hereinafter referred to as "PD sensor") 43B, as shown in FIG. 10. Current from a bias current source 41 and a pulse current source 42 are superimposed, the resulting sum current is supplied to the laser emitting device 43A, and a laser beam from the laser emitting device 43A is photoelectrically converted into a detection signal by the PD sensor 43B. The detection signal (current) is fed back to the bias current source 41, whereby the amount of bias current (reference current amount), that is, the luminous intensity of the laser beam is controlled to a constant value. This control of the bias current amount is performed whenever main scanning is carried out but before image formation is carried out.

Specifically, a sequence controller 47, upon input of a synchronization signal for synchronization of the main scanning, outputs a full light signal to an OR gate 40 to turn a switch 49 on. Upon turn-on of the switch 49, the sum of current from the bias current source 41 and current from the pulse current source 42 flows to the laser chip 43, and at this time an output signal (current) from the PD sensor 43B is input to a current-to-voltage converter 44 where the output signal is converted into a voltage signal. This voltage signal is amplified by an amplifier 45 and the amplified voltage signal is input to an APC (Auto Power Control) circuit 46. The APC circuit 46 compares the input voltage signal with a reference voltage and generates a control signal for controlling the bias current amount to a constant value, depending upon the comparison result, and supplies the control signal to the bias current source 41. The above type of circuit is an APC circuit type, which is generally used as a type of circuit for driving a laser beam.

After thus adjusting the bias current to a constant value, the sequence controller 47 turns off the full light signal. The switch 49 is then switched on and off by a PWM signal which is modulated based on the image signal by a modulator 48, so that the pulse current based on the image signal is superimposed upon the bias current, and the resulting sum current is fed to the laser emitting device 43A, whereby an electrostatic latent image is formed on the photosensitive member.

However, even if the photosensitive member is irradiated by a laser beam controlled to a constant luminous intensity, potential irregularities of 5V or more (surface potential irregularities and electrostatic latent image potential irregularities) can occur in both the main- and sub-scanning directions due to irregularities in the surface characteristics of the photosensitive member. Such potential irregularities result in non-uniformity of the density of the image formed.

One of the causes of such potential irregularities is irregularities of the thickness of the thin film of the photosensitive member. It is very difficult to manufacture a photosensitive member with a uniform thin film thickness. A non-uniform thin film of the photosensitive member typically results in unevenness in pattern between main scanning lines. Such a photosensitive member, when used, causes density irregularities of the image formed in the longitudinal direction on the image plane, degrading the image.

Moreover, improper assembly of component parts of the image forming apparatus around the photosensitive member, such as variations in the gap between the charging device and the photosensitive member or in the gap between the photosensitive member and the developing device or inclination of the charging device or the developing device relative to the photosensitive member, causes potential irregularities in the main scanning direction. Such potential irregularities also results in unevenness in pattern between main scanning lines.

SUMMARY OF THE INVENTION

It is an object of the present invention to provide an image forming apparatus and a method of controlling the image forming apparatus which are capable of eliminating density irregularities of an image formed caused by potential irregularities of the photosensitive member when the drum is irradiated by a beam of constant luminous intensity, and a program for implementing the method.

To attain the above object, in a first aspect of the present invention, there is provided an image forming apparatus comprising a photosensitive member, a beam emitting device that irradiates a beam modulated based on an image signal onto the photosensitive member to form an electrostatic latent image on the photosensitive member, a variable current control device that variably controls a driving current for driving the beam emitting device, a modulating device that modulates a pulse width of the beam based on the image signal, a measuring device that measures a potential of the photosensitive member after the photosensitive member is irradiated by a beam having a predetermined luminous intensity, and a control device that causes the variable current device to correct the driving current based on low frequency components of irregularities of the potential measured by the measuring device and changes a modulation coefficient used for modulating the pulse width by the modulating device based on high frequency components of the irregularities of the potential measured by the measuring device, to thereby form an image based on the image signal.

Preferably, the measuring device measures the potential on a main scanning line of the photosensitive member after the photosensitive member has been irradiated by a beam of the predetermined luminous intensity only for one main scanning line.

Preferably, the control device causes the variable current control device to correct the driving current for each predetermined number of pixels and changes the modulating coefficient used for modulating the pulse width.

Preferably, the modulating device has a plurality of image signal vs pulse width conversion tables corresponding to an image signal of same density, and the control device changes the modulating coefficient used for modulating the pulse width by selecting one of the image signal vs pulse conversion tables based on the high frequency components.

To attain the above object, in a second aspect of the present invention, there is provided an image forming apparatus comprising a photosensitive member, a beam emitting device that irradiates a beam modulated based on an image signal onto the photosensitive member to form an electrostatic latent image on the photosensitive member, a variable current control device that variably controls a driving current for driving the beam emitting device, a modulating device that modulates a pulse width of the beam based on the image signal, a measuring device that measures a density of an image obtained by developing an electrostatic latent image formed when the photosensitive member is irradiated by a beam having a predetermined luminous intensity, a control device that causes the variable current device to correct the driving current based on low frequency components of irregularities of the density of the image measured by the measuring device and changes a modulation coefficient used for modulating the pulse width by the modulating device based on high frequency components of the irregularities of the density of the image measured by the measuring device, to thereby form an image based on the image signal.

Preferably, the measuring device measures the density of a developed image on the photosensitive member.

Preferably, the measuring device measures the density of an image that has been transferred onto a recording sheet from the photosensitive member and fixed after development.

Preferably, the measuring device measures the density of an image developed from an electrostatic latent image formed by irradiating a beam of the predetermined luminous intensity onto the photosensitive member only for one main scanning line.

Preferably, the control device causes the variable current control device to correct the driving current for each predetermined number of pixels and changes the modulating coefficient used for modulating the pulse width.

Preferably, the modulating device has a plurality of image signal vs pulse width conversion tables corresponding to an image signal of same density, and the control device changes the modulating coefficient used for modulating the pulse width by selecting one of the image signal vs pulse conversion tables based on the high frequency components.

To attain the above object, in a third aspect of the present invention, there is provided a method of controlling an image forming apparatus that forms an image by forming an electrostatic latent image on a photosensitive member by irradiating a beam modulated based on an image signal from a beam emitting device onto the photosensitive member, the method comprising the steps of variably controlling a driving current for driving the beam emitting device, modulating a pulse width of the beam based on the image signal, measuring a potential of the photosensitive member after the photosensitive member is irradiated by a beam having a predetermined luminous intensity, causing the variable control step to correct the driving current based on low frequency components of irregularities of the potential measured in the measuring step and changing a modulation coefficient used for modulating the pulse width in the modulating step based on high frequency components of the irregularities of the potential measured in the measuring step, to thereby form an image based on the image signal.

To attain the above object, in a fourth aspect of the present invention, there is provided a method of controlling an image forming apparatus that forms an image by forming an electrostatic latent image on a photosensitive member by irradiating a beam modulated based on an image signal from a beam emitting device onto the photosensitive member, the method comprising the steps of, variably controlling a driving current for driving the beam emitting device, modulating a pulse width of the beam based on the image signal, measuring a density of an image obtained by developing an electrostatic latent image formed when the photosensitive member is irradiated by a beam having a predetermined luminous intensity, causing the variable control step to correct the driving current based on low frequency components of irregularities of the density of the image measured in the measuring step and changing a modulation coefficient used for modulating the pulse width in the modulating step based on high frequency components of the irregularities of the density of the image measured in the measuring step, to thereby form an image based on the image signal.

To attain the above object, in a fifth aspect of the present invention, there is provided a program for implementing a method of controlling an image forming apparatus that forms an image by forming an electrostatic latent image on a photosensitive member by irradiating a beam pulse width modulated based on an image signal from a beam emitting device onto the photosensitive member, the program comprising a measuring module for measuring a surface potential of the photosensitive member after main scanning is carried out on the photosensitive member by a beam having a predetermined luminous intensity, an extracting module for extracting low frequency components and high frequency components from frequency components of irregularities of the surface potential, a correcting module for correcting irregularities of the surface potential of the low frequency components by driving current supplied to the beam emitting device and correcting irregularities of the surface potential of the high frequency components by pulse width modulation, to thereby form an image based on the image signal.

To attain the above object, in a sixth aspect of the present invention, there is provided a program for implementing a method of controlling an image forming apparatus that forms an image by forming an electrostatic latent image on a photosensitive member by irradiating a beam pulse width modulated based on an image signal from a beam emitting device onto the photosensitive member, the program comprising a measuring module for measuring a density of an image developed from an electrostatic latent image formed by main scanning carried out on the photosensitive member by a beam having a predetermined luminous intensity, an extracting module for extracting low frequency components and high frequency components from frequency components of irregularities of the density of the developed image, and a correcting module for correcting irregularities of the density of the low frequency components by driving current supplied to the beam emitting device and correcting irregularities of the density of the high frequency components by pulse width modulation, to thereby form an image based on the image signal.

The above and other objects, features, and advantages of the invention will become more apparent from the following detailed description taken in conjunction with the accompanying drawings.

DETAILED DESCRIPTION OF THE PREFERRED EMBODIMENTS

The present invention will now be described in detail with reference to the drawings showing a preferred embodiment thereof.

Figure 1:
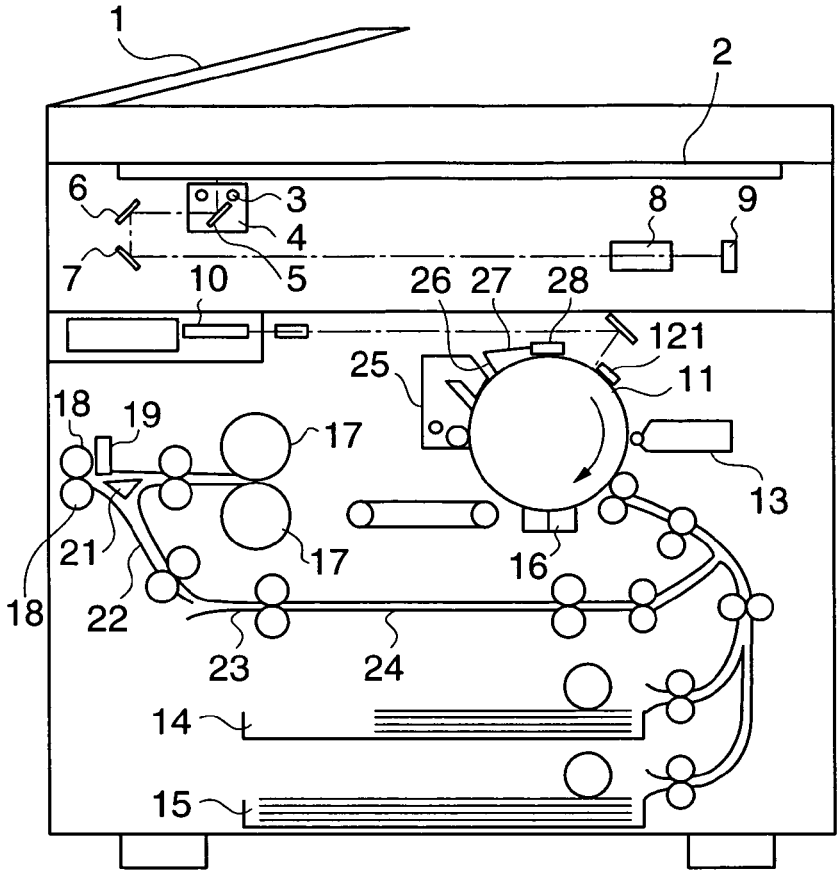
FIG. 1 is a cross-sectional view schematically showing a multi-functional printer as an image forming apparatus according to an embodiment of the present invention.

FIG. 1 is a cross-sectional view schematically showing a multi-functional printer as an image forming apparatus according to an embodiment of the present invention.

As shown in FIG. 1, originals stacked on an original feeding device are conveyed one by one onto a glass platen 2. Whenever an original is conveyed onto the glass platen 2, a lamp 3 is turned on and a scanner unit 4 that includes the lamp 3 moves and scans the original image. Light (image light) reflected from the original enters an image sensor 9 after being reflected by mirrors 5, 6, and 7 and converged by a lens 8.

The image sensor 9 photoelectrically transfers the light reflected from the original into an analog electrical image signal. The analog image signal from the image sensor 9 is converted by a circuit, not shown, into a digital image signal that is then subjected to various processes, such as shading correction, γ correction, and multivaluing process, and then temporarily stored as multivalued image data exhibiting multi-level gradation image density in an image memory, not shown, whence it is read out from the image memory and input to an exposure control unit 10.

In the exposure control unit 10, a PWM pulse width converter 101 (see FIG. 3), referred to later, converts the input image data into a pulse width modulated (PWM) signal, which is then delivered via a laser driver 31 to a laser chip 43 (see FIG. 3), whereby a laser beam irradiated onto a photosensitive drum 11 is turned on and off according to the pulse width of the PWM signal. An electrostatic latent image is formed on the photosensitive drum 11 by the laser beam irradiated onto the drum 11. This electrostatic latent image is developed into a toner image by a developing device 13.

In timing synchronous with the above formation of the electrostatic latent image, a recording sheet is picked up from a sheet cassette 14 or 15 and conveyed to a transfer unit 16. The transfer unit 16 transfers the developed toner image on the photosensitive drum onto the recording sheet. The recording sheet onto which the toner image has thus been transferred is conveyed to a fixing unit 17 where it is subjected to a fixing process, and in a normal printing mode, the recording sheet is then discharged from the image forming apparatus.

On the other hand, in a double-sided printing mode, after the recording sheet passes a sheet discharge sensor 19, a sheet discharge roller pair 18 is rotated in a direction reverse to the sheet discharging direction and at the same time a flapper 21 is raised up, and accordingly the recording sheet with the toner image fixed thereto is conveyed via conveying paths 22 and 23 and loaded into an intermediate tray 24 without being turned upside down. Then, the recording sheet thus stored in the intermediate tray 24 is conveyed again to the transfer unit 16 (the recording sheet is turned upside down during this conveyance), where a toner image from the photosensitive drum 11 is transferred onto the other side surface of the recording sheet.

Moreover, in a multiple image printing mode, the flapper 21 is raised up before the recording sheet passes the sheet discharge sensor 19 and accordingly the recording sheet with the toner image fixed thereto is temporarily stored in the intermediate tray 24 via the conveying paths 22 and 23 after being turned upside down. The recording sheet stored in the intermediate tray 24 is conveyed again to the transfer unit 16 and a toner image from the photosensitive drum is transferred onto the same side surface of the sheet onto which a previous tone image was fixed.

After the transfer process is completed, the photosensitive drum 11 has its surface cleaned by a cleaner 25 and discharged by an auxiliary charging device 26. Any residual charge is eliminated by irradiating the drum with a pre-exposure lamp 27 and then the surface of the drum 11 is then charged again by a primary charging device 28, to thereby prepare for the next image forming process. In FIG. 1, reference numeral 121 designates a potential sensor, which will be described later.

Figure 2:
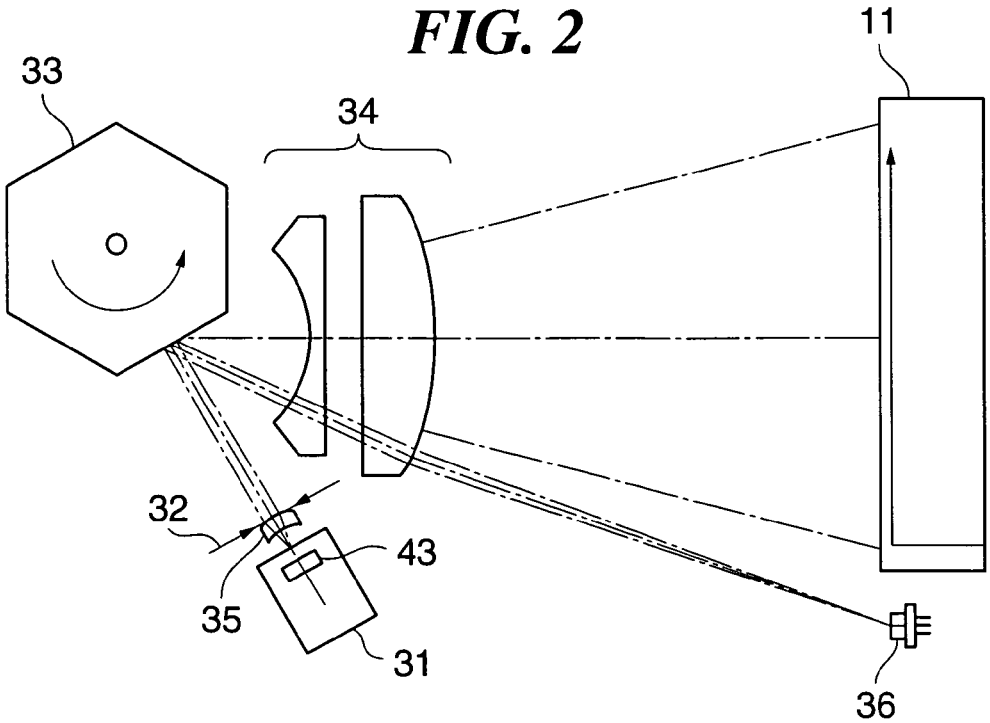
FIG. 2 is a diagram showing the mechanical configuration of an exposure control unit of the multi-functional printer in FIG. 1.

FIG. 2 shows the mechanical configuration of the exposure control unit 10. As shown in FIG. 2, the laser driver 31 switches on and off the laser beams radiated by the laser emitting device 43A (see also FIG. 10) of the laser chip 43 according to the pulse width of the PWM signal. The laser chip 43 also incorporates a photo-diode (PD) sensor 43B (see FIG. 10) that detects the quantity of laser beams radiated by the laser emitting device 43A, and APC control is carried out using the detected laser beam quantity.

Laser beams radiated by the laser emitting device 43A are shaped by a collimator lens 35 and a diaphragm 32 into parallel beams having a predetermined diameter. The parallel beams enter a rotary polygonal mirror 33, which is rotated by a polygonal motor, not shown, at a constant angular speed in a direction indicated by an arrow in FIG. 2. The direction (advancing direction) in which the laser beams incident on the polygonal mirror 33 are reflected by the mirror 33 is deflected at a constant angular speed by the rotating polygonal mirror 33. The laser beams thus deflected in their advancing direction are irradiated via a F-θ lens 34 onto the photosensitive drum 11 to expose and scan the same. At this time, the F-θ lens 34 corrects for changes in main scanning speed caused by differences in the optical path length of the laser beams deflected in the advancing direction by the polygonal mirror 33 before the laser beams reach the photosensitive drum 11, to thereby make the main scanning speed the same over the entire scanning surface of the photosensitive drum 11.

In FIG. 2, reference numeral 36 designates a beam detection sensor (hereinafter referred to as "the BD sensor") that detects the laser beams deflected by the rotating polygonal mirror 33. After the detection of the laser beams by the BD sensor 36, the APC control, referred to hereinbefore, is carried out, and after the lapse of a predetermined time period, exposure and scanning (main scanning) using laser beams pulse width modulated based upon the image data is started.

Figure 3:
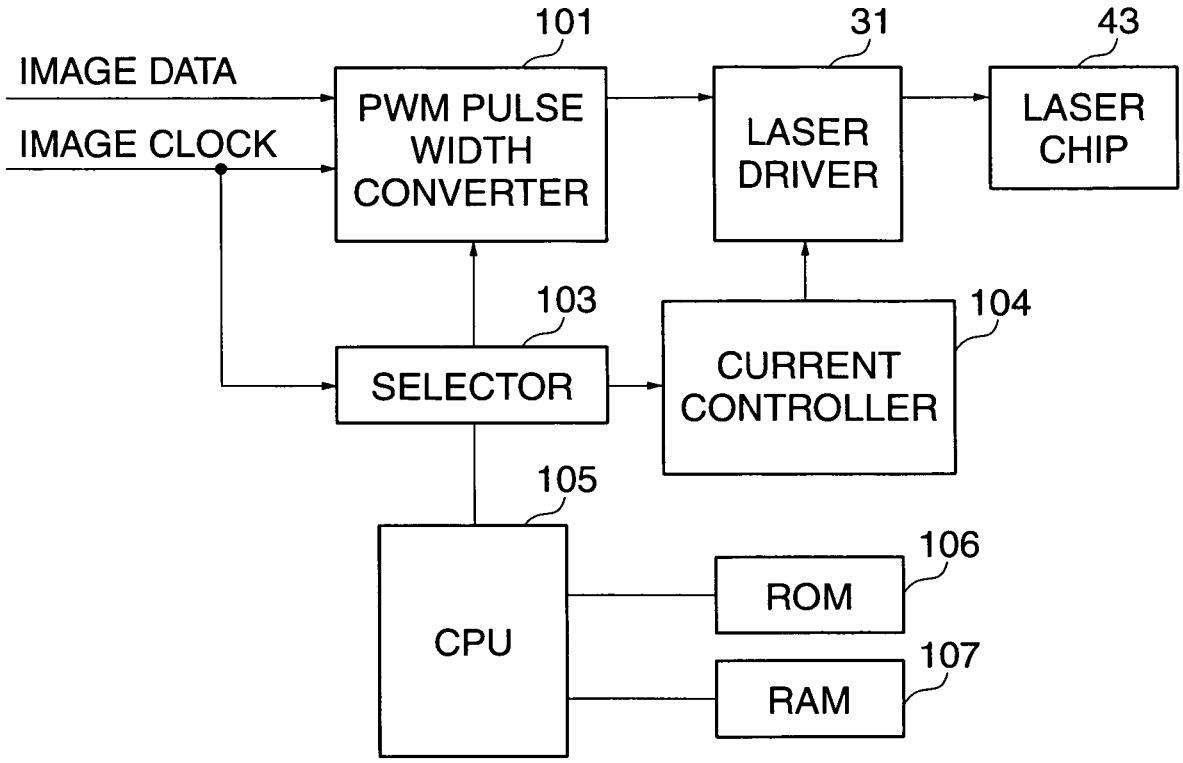
FIG. 3 is a block diagram showing the electrical configuration of the exposure control unit of the multi-functional printer in FIG. 1.

FIG. 3 is a block diagram showing the electrical configuration of the exposure control unit 10.

Figure 10:
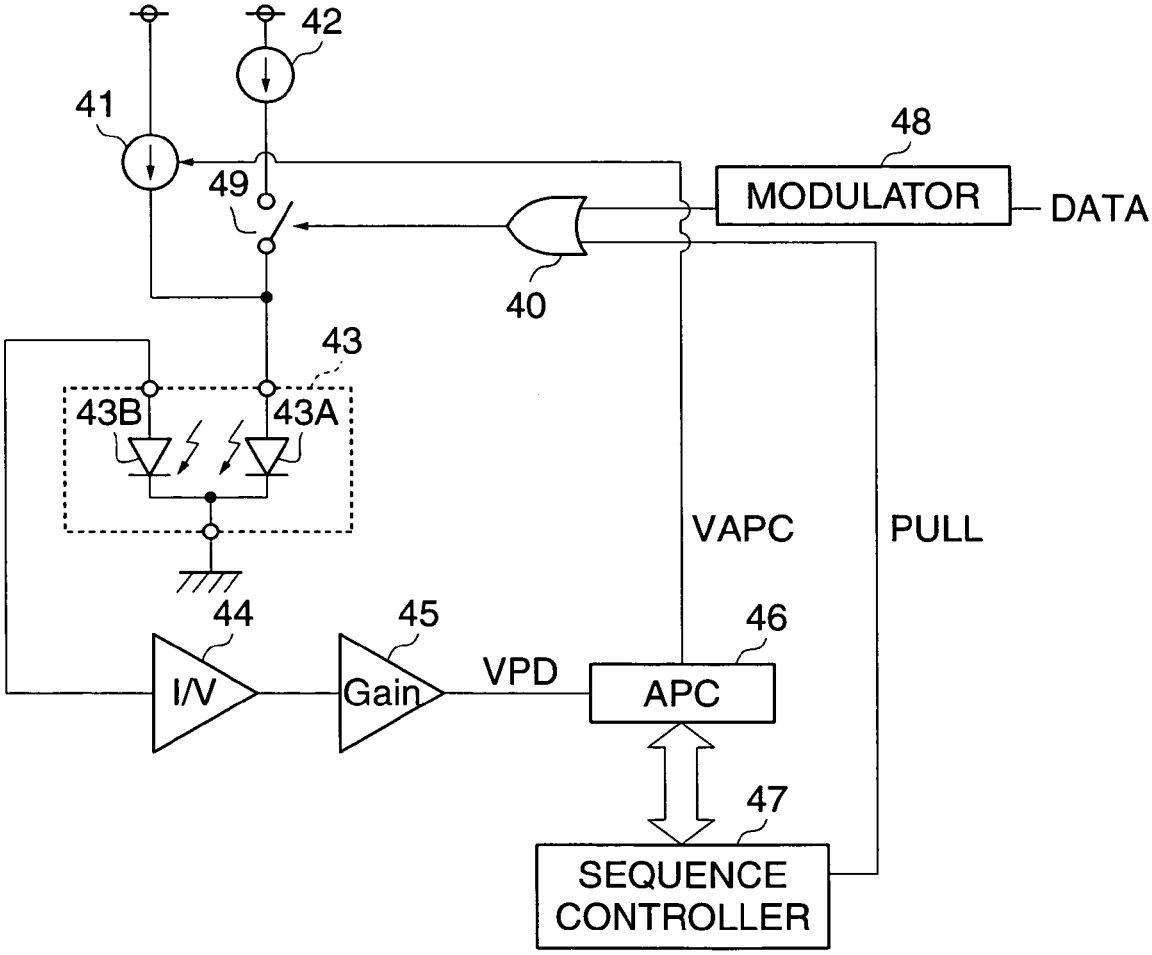
FIG. 10 PRIOR ART
FIG. 10 is a diagram showing the configuration of an APC circuit of a conventional image forming apparatus.

As shown in FIG. 3, the multivalued image data exhibiting multi-level gradation image density is converted by the PWM pulse width converter 101 into a PWM signal, which is output to the laser driver 31. The laser driver 31 switches on and off the laser beam emitted from the laser emitting device 43A according to the pulse width of the PWM signal. The laser driver 31 includes a bias current source 41, a pulse current source 42, an OR gate 40, and a switch 49, all of which are shown in FIG. 10.

A central processing unit (CPU) 105 sets for a selector 103, selection information for selecting a predetermined PWM pattern table from a plurality of PWM pattern tables, referred to later, and a laser driving current value (a correction bias current value, referred to later) in association with count values of an image clock. The selector 103 counts the image clock, and when the count value reaches a predetermined count value related to the selection information, the selector 103 outputs a table select signal to the PWM pulse width converter 101, while when the count value reaches a predetermined count value related to the correction laser driving current value, the selector 103 outputs the correction laser driving current value to a current controller 104. The PWM pulse width converter 101 generates a PWM signal using the PWM pattern table selected by the table select signal. The current controller 104 controls the bias current source 41 (see FIG. 10) in the laser driver 31 to output a laser driving current (bias current) corresponding to the correction laser driving current value. It should be noted that the CPU 105 carries out the above-mentioned control as well as control described hereinafter, based on programs stored in a ROM 106. In carrying out these controls, the CPU 105 uses a RAM 107 as a working area.

Figure 7:
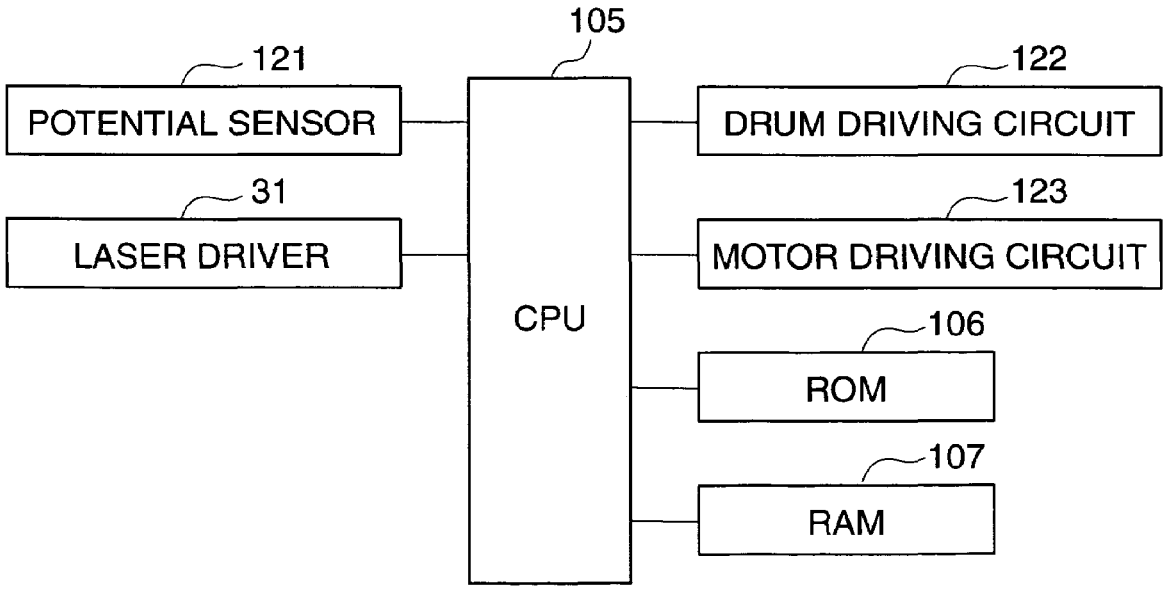
FIG. 7 is a block diagram showing the configuration of a device for measuring a potential on the photosensitive drum.

As shown in FIG. 7, connected to the CPU 105 are a potential sensor 121, a drum driving circuit 122, and a motor driving circuit 123. The potential sensor 121 is disposed to move along each main scanning line 120 of the photosensitive drum to thereby detect a surface potential along each main scanning line of the photosensitive drum 11. This moving control of the potential sensor 121 is carried out by the motor driving circuit 123 under the control of the CPU 105. Switching of main scanning lines, that is, the sub scanning is carried out by causing the drum driving circuit 122 to rotate the photosensitive drum 11.

Figure 4:
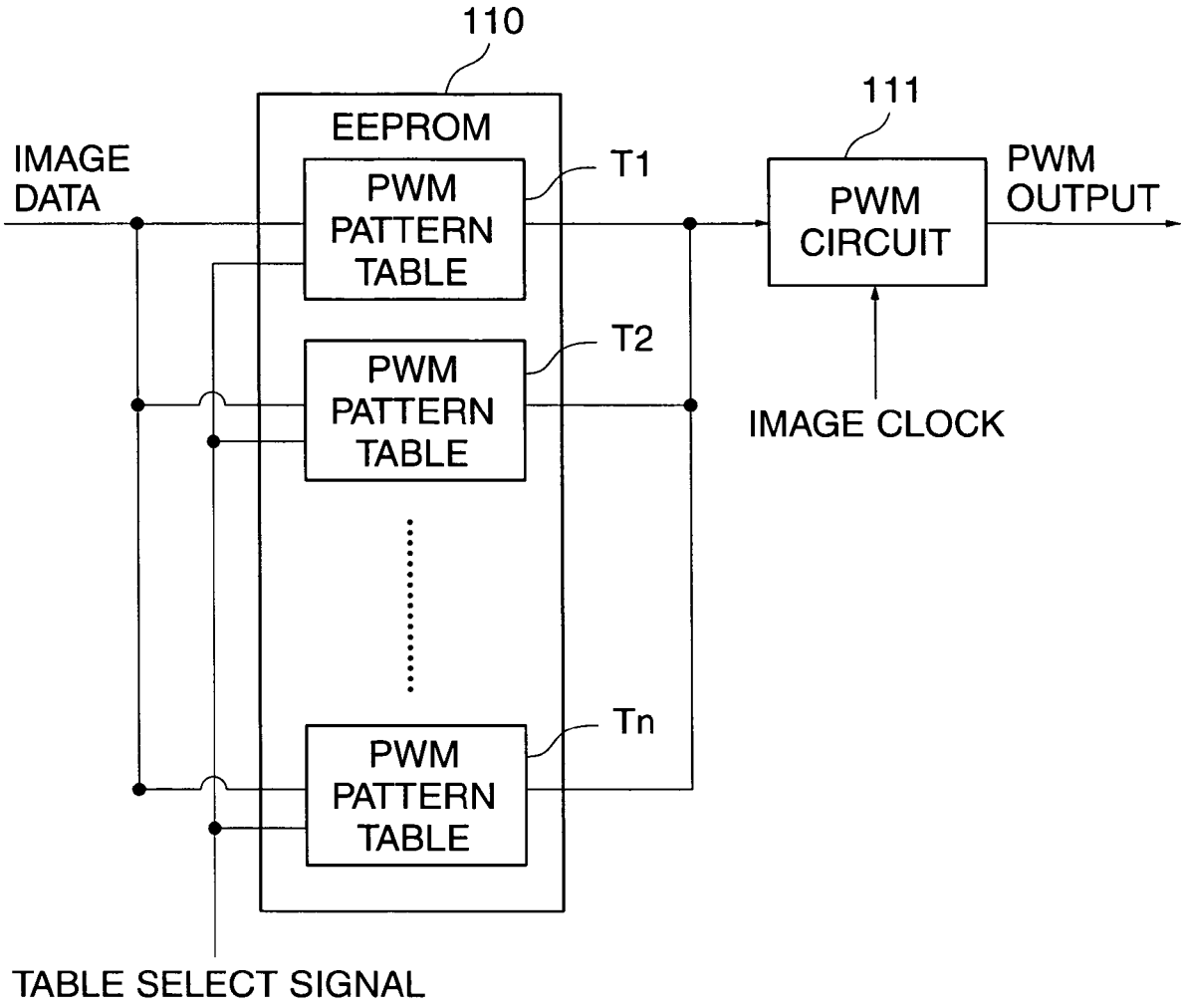
FIG. 4 is a block diagram showing the configuration of a PWM pulse width converter in the exposure control unit.

FIG. 4 is a block diagram showing the configuration of the pulse width converter 101. As shown in FIG. 4, the PWM pulse width converter 101 includes a nonvolatile memory 110, such as an EEPROM, and a PWM circuit 111. A plurality of PWM pattern tables T1, T2, . . . , Tn are stored in the nonvolatile memory 110.

Pulse width information for each pixel is registered in association with multivalued image data (density values) in the PWM pattern tables T1, T2, . . . , Tn. The PWM pulse width converter 101 converts input image data into pulse width information using one PWM pattern table selected from the pattern tables T1, T2, . . . , Tn by the table select signal, and the pulse width information is supplied to the PWM circuit 111. The PWM circuit 111 sequentially generates PWM signals whose pulse widths correspond to the supplied pulse width information in synchronism with the image clock and outputs the generated PWM signals to the laser driver 31.

The plurality of PWM pattern tables T1, T2, . . . , Tn have registered therein pulse width information indicative of different pulse widths, i.e., modulation coefficients for modulating image data to respective different pulse widths, for image data with the same density value. For example, pulse width information shown in FIG. 5A is registered in the PWM pattern table T1; pulse width information shown in FIG. 5B is registered in the PWM pattern table T2; and pulse width information shown in FIG. 5C is registered in the PWM pattern table Tn.

Figure 5A:
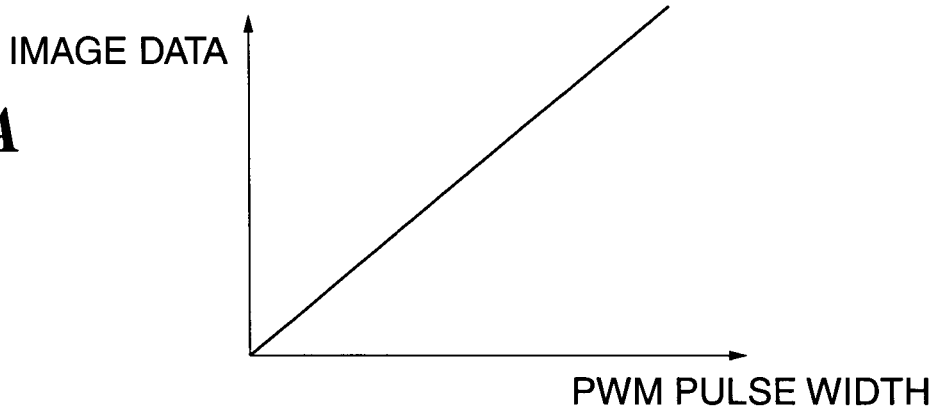
FIGS. 5A to 5C are graphs showing the relationship between PWM pulse width and image (intensity) data of respective PWM pattern tables.
Figure 5B:
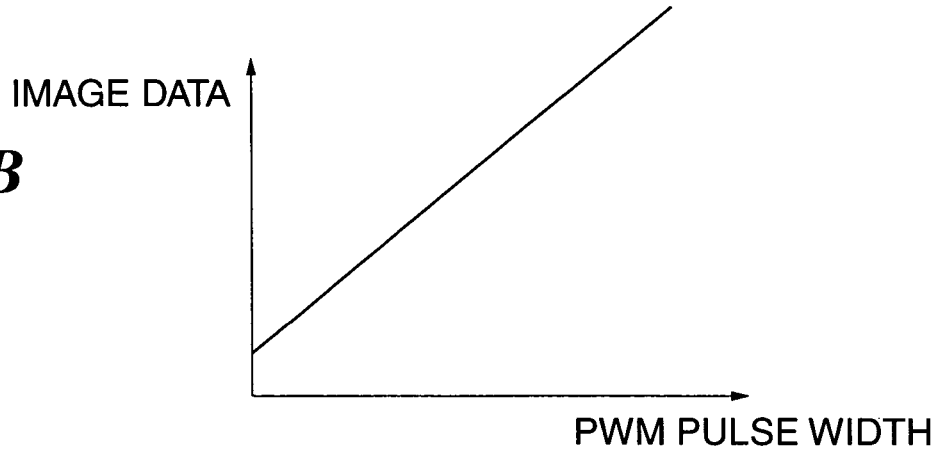
Figure 5C:
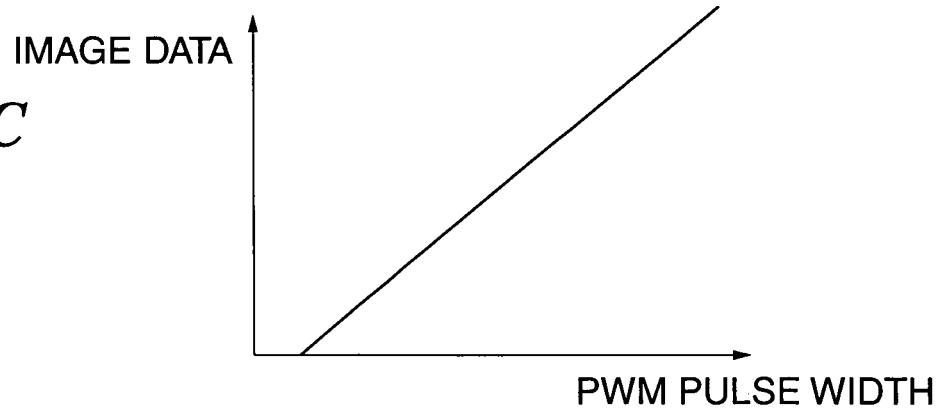

In the illustrated example, the pulse width information shown in FIG. 5B has a shorter pulse width compared with that in FIG. 5A for image data with the same density value. To reduce the image density, that is, lower the potential of an electrostatic latent image on the photosensitive drum 11 when the PWM pattern table T1 shown in FIG. 5A is used, the selector 103 can be set so as to use the PWM pattern table T2 shown in FIG. 5A. On the other hand, the pulse width information shown in FIG. 5C has a longer pulse width compared with that in FIG. 5A for image data with the same density value. To increase the image density, that is, raise the potential of an electrostatic latent image on the photosensitive drum 11 when the PWM pattern table T1 shown in FIG. 5A is used, the selector 103 can be set so as to use the PWM pattern table Tn shown in FIG. 5C.

Next, a description will be given of measurement of the surface potential on the photosensitive drum 11 with reference to FIG. 7. Measurement of the surface potential on the photosensitive drum 11 and setting of the selector 103 based on results of the measurement, described hereinafter, are usually carried out only once when the product is shipped or delivered.

Figure 6:
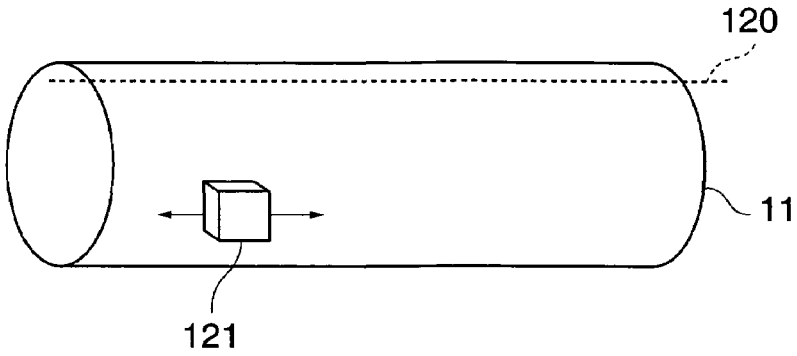
FIG. 6 is a view useful in explaining how a potential on a photosensitive drum is measured.

The CPU 105 operates on programs stored in the ROM 106 to instruct the drum driving circuit 122 to rotatively drive the photosensitive drum 11, and also set the laser driving current so as to obtain a predetermined light amount (that is, a light amount corresponding to a desired potential) and a PWM pulse width per pixel, to the laser driver 31. Further, the CPU 105 causes the polygonal mirror 32 to be driven to thereby form an electrostatic latent image corresponding to a predetermined density (desired potential) on each main scanning line (see reference numeral 120 in FIG. 6) of the photosensitive drum 11.

When the electrostatic latent image thus formed reaches a location where it is opposed to the electric potential sensor 121, the CPU 105 instructs the motor driving circuit 123 to move the electric potential sensor 121 along the main scanning line 120 to thereby sequentially read out surface potential values (i.e., potential values of the electrostatic latent image) of the photosensitive drum 11 detected by the potential sensor 121 and stores the read potential values in the RAM 107.

Figure 8A:
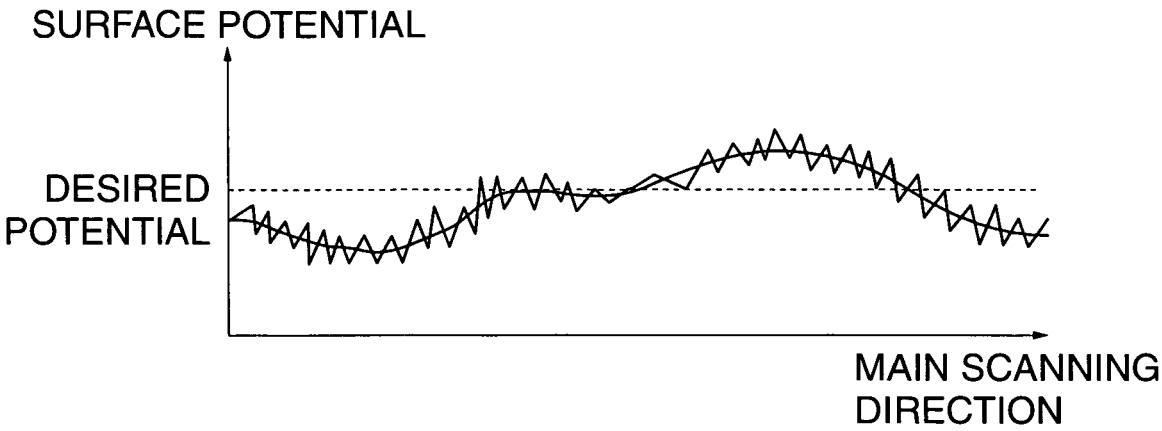
FIG. 8A is a graph showing measured surface potential irregularities on the photosensitive drum.

FIG. 8A is a graph showing surface potential irregularities on the photosensitive drum 11 detected by the potential sensor 121. In FIG. 8A, the ordinate indicates the surface potential, and the abscissa indicates the positions of various parts of the electrostatic latent image on the main scanning line. As shown in FIG. 8A, even when the surface potential (the potential of the electrostatic latent image) of the photosensitive drum 11 is set to the desired potential to form an electrostatic latent image, the actually measured surface potential of the photosensitive drum 11 usually varies from the desired potential.

Control of the laser driving current (bias current) alone to compensate for the potential irregularities cannot eliminate high frequency components of the potential irregularities, because such current control is low in response speed. On the other hand, control of the pulse width alone to compensate for the potential irregularities necessitates provision of a greater number of PWM pattern tables for pulse width modulation as the number of patterns of potential irregularities on each scanning line is greater, thus requiring a complicated and large-scaled compensation circuit. Therefore, in the present embodiment, both the control of the laser driving current (bias current) and the control of the pulse width are used to compensate for the potential irregularities.

Figure 8B:
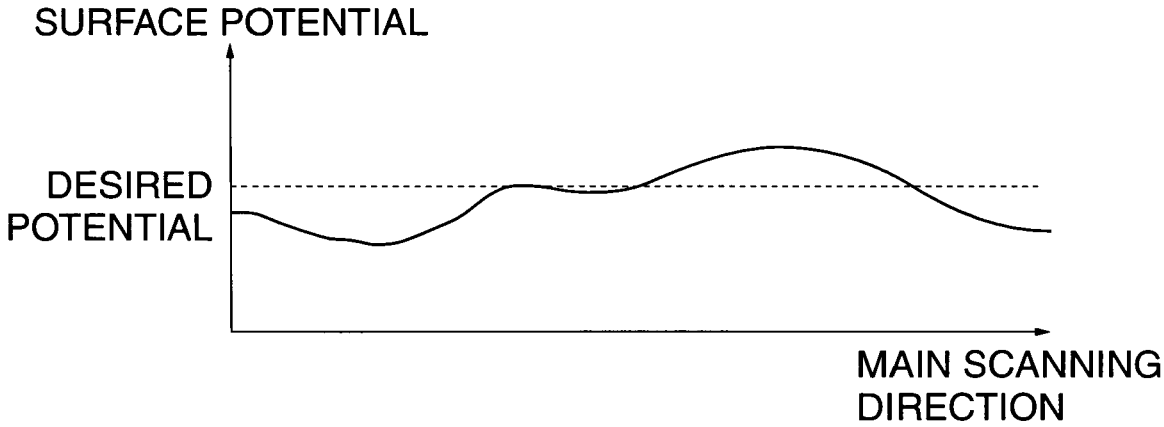
FIG. 8B is a graph showing low frequency components extracted from the measured surface potential irregularities in FIG. 8A.

Specifically, the CPU 105 carries out averaging of potential signals for pixels stored in the RAM 107 for each predetermined number of pixels, using root-mean-square or the like. The resulting averaged potential signal group depicts a low frequency component curve as shown in FIG. 8B. To remove the low frequency components to make the potential on the photosensitive drum 11 closer to the desired potential, the CPU 105 sets a laser driving current value (correction bias current value) to compensate for a difference from the desired potential, to the selector 103.

Figure 8C:
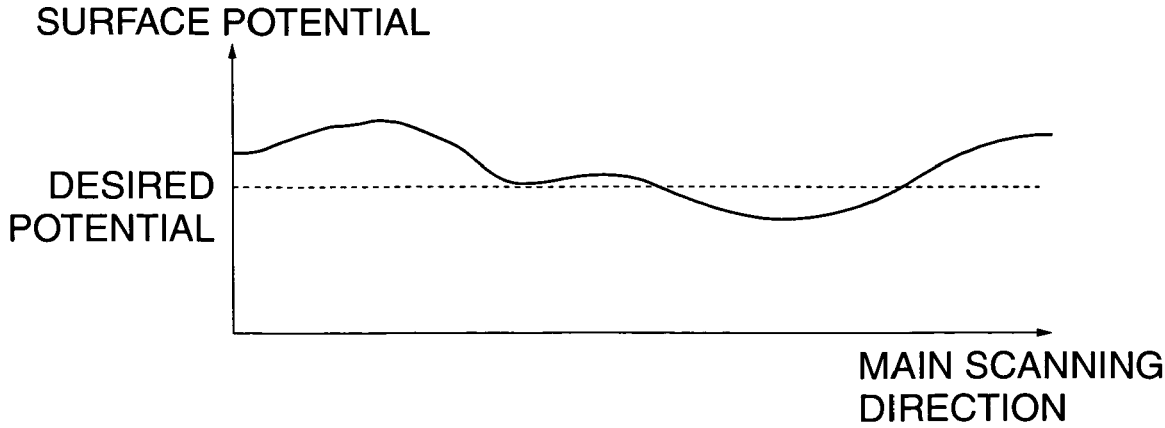
FIG. 8C is a graph showing laser driving current for correcting the low frequency components in FIG. 8B.

Here, the actual bias current value set to the selector 103 by the CPU 105 is a current value corresponding to the averaged potential signal group, as shown in FIG. 8C. In this case, the CPU 105 sets to the selector 103 the correction bias current value for each predetermined number of pixels used in the above averaging, i.e. every predetermined number of image clocks. The selector 103 then counts the image clock with reference to a BD signal, and each time the count value reaches the predetermined number of image clocks corresponding to the predetermined number of pixels, the selector 103 outputs a correction bias current value to the current controller 104. It should be noted that this correction bias current value is different from the bias current value for the APC control, referred to before. In actual image formation, the bias current value for the APC control and the correction bias current value are added up into the sum bias current value, with which the laser emitting device 43A is then driven.

Figure 9A:
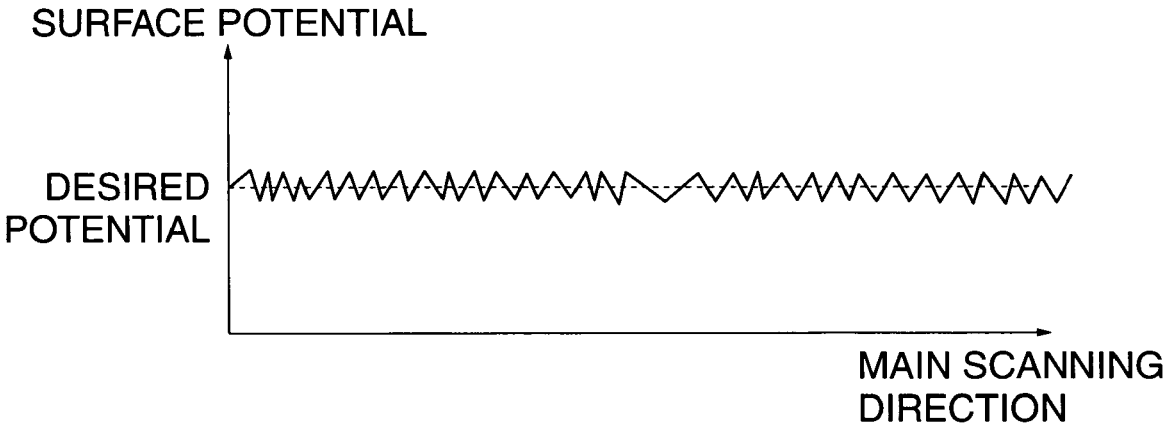
FIG. 9A is a graph showing high frequency components of the measured surface potential irregularities.
Figure 9B:
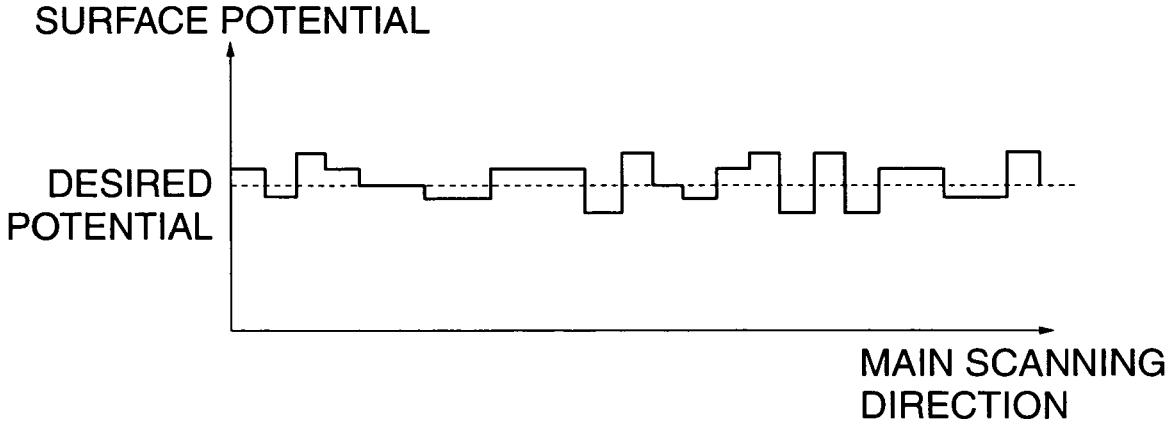
FIG. 9B is a graph showing the high frequency components on an enlarged scale.

Further, the CPU 105 obtains a potential signal group of high frequency components as shown in FIG. 9A by subtracting the low frequency components as shown in FIG. 8B from the potential signal group as shown in FIG. 8A, which have been detected by the potential sensor 121. The obtained potential signal group of high frequency components is shown on an enlarged scale in FIG. 9B. Thus, a potential difference between the desired potential and the actual measured potential is obtained for each pixel group by which the above averaging was carried out.

For a pixel group whose measured potential is greater than the desired potential, the CPU 105 sets the selector 103 so as to output a pulse of shorter pulse width for image data of the same density using the PWM pattern table T2 shown in FIG. 5B to thereby decrease the surface potential on the photosensitive drum 11 and hence decrease the image density. For a pixel group whose measured potential is less than the desired potential, the CPU 105 sets the selector 103 so as to output a pulse of longer pulse width for image data of the same density using the PWM pattern table Tn shown in FIG. 5C, to thereby increase the surface potential on the photosensitive drum 11 and hence increase the image density.

In this case, the CPU 105 sets a signal that indicates which PWM pattern table is to be used starting with which image clock with reference to the BD signal, to the selector 103. Specifically, the CPU 105 sets the number of image clocks after the BD signal and the selection information (discrimination information) for selecting the PWM pattern table to be selected, to the selector 103 such that the PWM pattern table T1 is used from the 100th image clock (signal writing position) after the BD signal, and the PWM pattern table T2 is used from the 110th image clock.

When an image is actually formed, the selector 103 counts the number of image clocks, outputs a correction laser driving current to the current controller 104 when the count value reaches the number of image clocks corresponding to the correction laser driving current, and outputs a table select signal to the PWM pulse width converter 101 when the count value reaches the number of image clocks corresponding to the table selection information.

As described above, according to the present embodiment, the surface potential of the photosensitive drum 11 is measured after completing the main scanning of the photosensitive drum 11 with a laser beam of constant luminous intensity, low frequency components and high frequency components are extracted from the frequency components of surface potential irregularities, and when an image is actually formed based on an image signal, the low frequency component potential irregularities are corrected by the laser driving current (bias current), and the high frequency component potential irregularities are corrected by pulse width modulation. As a result, it is possible to reduce surface potential irregularities on the photosensitive drum 11 and obtain a higher quality image while overcoming the problem of low response speed when the correction by the laser driving current alone is carried out, and the problem of the compensation circuit becoming complicated and large scaled when the correction by the PWM pulse width alone is carried out.

Alternatively to measuring the surface potential of the photosensitive drum 11 as in the above described embodiment, a half tone image (toner image) of a predetermined image density may be formed for only one main scanning line on the photosensitive drum. In this case, the toner image formed on the photosensitive drum is read in the main scanning direction by a density sensor, low frequency components and high frequency components are extracted from the frequency components of density irregularities of the read density data, and the low frequency component density irregularities are corrected by laser driving current (bias current), and high frequency component density irregularities are corrected by pulse width modulation.

Further alternatively, a half tone image (toner image) of a predetermined image density may be formed for only one main scanning line on the photosensitive drum, followed by the formed toner image being transferred onto a sheet and fixed. In this case, the toner image on the sheet is read by the scanner unit 4 and the image sensor 9, low frequency components and high frequency components are extracted from the frequency components of an image density signal output from the image sensor 9, density irregularities of the low frequency components are corrected by laser driving current (bias current) and density irregularities of the high frequency components are corrected by pulse width modulation to copy and place a toner image onto a paper, to read a toner image on this paper by the scanner unit 4 and the image sensor 9, to extract the low frequency component and high frequency component from image density irregularities of the image density signal from the image sensor 9, to correct low frequency image density irregularities by means of laser driving current (bias current), to correct high frequency image density irregularities by means of pulse modulation.

Measurement of density irregularities of an actual image (toner image) thus formed showed that the density irregularities include density irregularities caused by the gap between the photosensitive drum 11 and the developing device 13 not being constant in the main scanning direction. The above described first alternative example can also correct such density irregularities caused by the gap between the photosensitive drum 11 and the developing device 13 not being constant in the main scanning direction.

The present invention is not limited to the above described embodiment and alternative examples. For example, instead of setting the correction laser driving current and the selection information for selecting the PWM pattern tables corresponding to the respective numbers of image clocks after the BD signal or the count values of the same, it is possible to set the correction laser driving current and the selection information for selecting the PWM pattern tables corresponding to the respective numbers of image clocks after an image writing signal which is output after the detection of the BD signal or the count values of the same.

It is to be understood that the object of the present invention may also be accomplished by providing a system or an apparatus with a storage medium in which a program code of software which realizes the functions of the above described embodiment is stored, and causing a computer (or CPU or MPU) of the system or apparatus to read out and execute the program code stored in the storage medium.

In this case, the program code itself read from the storage medium realizes the functions of the embodiment described above, and hence the program code and the storage medium in which the program code is stored constitute the present invention.

Examples of the storage medium for supplying the program code include a floppy (registered trademark) disk, a hard disk, a magnetic-optical disk, a CD-ROM, a CD-R, a CD-RW, DVD-ROM, a DVD-RAM, a DVD-RW, a DVD+RW, a magnetic tape, a nonvolatile memory card, and a ROM. Alternatively, the program may be downloaded via a network.

Further, it is to be understood that the functions of the above described embodiment may be accomplished not only by executing a program code read out by a computer, but also by causing an OS (operating system) or the like which operates on the computer to perform a part or all of the actual operations based on instructions of the program code. Further, it is to be understood that the functions of the above described embodiment may be accomplished by writing a program code read out from the storage medium into a memory provided on an expansion board inserted into a computer or in an expansion unit connected to the computer and then causing a CPU or the like provided in the expansion board or the expansion unit to perform a part or all of the actual operations based on instructions of the program code.

CROSS REFERENCE TO RELATED APPLICATION

This application claims priority from Japanese Patent Application No. 2004-040017 filed Feb. 17, 2004, which is hereby incorporated by reference herein.

What is claimed is:

1. An image forming apparatus comprising:

a photosensitive member;

a beam emitting device that irradiates a beam modulated based on an image signal onto said photosensitive member to form an electrostatic latent image on said photosensitive member;

a variable current control device that variably controls a driving current for driving said beam emitting device;

a modulating device that modulates a pulse width of the beam based on the image signal;

a measuring device that measures a potential of said photosensitive member after said photosensitive member is irradiated by a beam having a predetermined luminous intensity; and a control device that causes said variable current device to correct the driving current based on low frequency components of irregularities of the potential measured by said measuring device and changes a modulation coefficient used for modulating the pulse width by said modulating device based on high frequency components of the irregularities of the potential measured by said measuring device, to thereby form an image based on the image signal.

2. An image forming apparatus as claimed in claim 1, wherein said measuring device measures the potential on a main scanning line of said photosensitive member after said photosensitive member has been irradiated by a beam of the predetermined luminous intensity only for one main scanning line.

3. An image forming apparatus as claimed in claim 1, wherein said control device causes said variable current control device to correct the driving current for each predetermined number of pixels and changes the modulating coefficient used for modulating the pulse width.

4. An image forming apparatus as claimed in claim 1, wherein said modulating device has a plurality of image signal vs pulse width conversion tables corresponding to an image signal of same density, and said control device changes the modulating coefficient used for modulating the pulse width by selecting one of the image signal vs pulse conversion tables based on the high frequency components.

5. An image forming apparatus comprising:

a photosensitive member;

a beam emitting device that irradiates a beam modulated based on an image signal onto said photosensitive member to form an electrostatic latent image on said photosensitive member;

a variable current control device that variably controls a driving current for driving said beam emitting device;

a modulating device that modulates a pulse width of the beam based on the image signal;

a measuring device that measures a density of an image obtained by developing an electrostatic latent image formed when said photosensitive member is irradiated by a beam having a predetermined luminous intensity;

a control device that causes said variable current device to correct the driving current based on low frequency components of irregularities of the density of the image measured by said measuring device and changes a modulation coefficient used for modulating the pulse width by said modulating device based on high frequency components of the irregularities of the density of the image measured by said measuring device, to thereby form an image based on the image signal.

6. An image forming apparatus as claimed in claim 5, wherein said measuring device measures the density of a developed image on said photosensitive member.

7. An image forming apparatus as claimed in claim 5, wherein said measuring device measures the density of an image that has been transferred onto a recording sheet from said photosensitive member and fixed after development.

8. An image forming apparatus as claimed in claim 5, wherein said measuring device measures the density of an image developed from an electrostatic latent image formed by irradiating a beam of the predetermined luminous intensity onto said photosensitive member only for one main scanning line.

9. An image forming apparatus as claimed in claim 5, wherein said control device causes said variable current control device to correct the driving current for each predetermined number of pixels and changes the modulating coefficient used for modulating the pulse width.

10. An image forming apparatus as claimed in claim 5, wherein said modulating device has a plurality of image signal vs pulse width conversion tables corresponding to an image signal of same density, and said control device changes the modulating coefficient used for modulating the pulse width by selecting one of the image signal vs pulse conversion tables based on the high frequency components.

11. A method of controlling an image forming apparatus that forms an image by forming an electrostatic latent image on a photosensitive member by irradiating a beam modulated based on an image signal from a beam emitting device onto the photosensitive member, the method comprising the steps of:

variably controlling a driving current for driving the beam emitting device;

modulating a pulse width of the beam based on the image signal;

measuring a potential of the photosensitive member after the photosensitive member is irradiated by a beam having a predetermined luminous intensity;

causing the variable control step to correct the driving current based on low frequency components of irregularities of the potential measured in said measuring step and changing a modulation coefficient used for modulating the pulse width in said modulating step based on high frequency components of the irregularities of the potential measured in said measuring step, to thereby form an image based on the image signal.

12. A method of controlling an image forming apparatus that forms an image by forming an electrostatic latent image on a photosensitive member by irradiating a beam modulated based on an image signal from a beam emitting device onto the photosensitive member, the method comprising the steps of;

variably controlling a driving current for driving the beam emitting device;

modulating a pulse width of the beam based on the image signal;

measuring a density of an image obtained by developing an electrostatic latent image formed when the photosensitive member is irradiated by a beam having a predetermined luminous intensity;

causing said variable control step to correct the driving current based on low frequency components of irregularities of the density of the image measured in said measuring step and changing a modulation coefficient used for modulating the pulse width in said modulating step based on high frequency components of the irregularities of the density of the image measured in said measuring step, to thereby form an image based on the image signal.

13. A computer-readable medium comprising a program for causing a computer to execute a method of controlling an image forming apparatus that forms an image by forming an electrostatic latent image on a photosensitive member by irradiating a beam pulse width modulated based on an image signal from a beam emitting device onto the photosensitive member, the program comprising:

a measuring module for measuring a surface potential of the photosensitive member after main scanning is carried out on the photosensitive member by a beam having a predetermined luminous intensity;

an extracting module for extracting low frequency components and high frequency components from frequency components of irregularities of the surface potential;

a correcting module for correcting irregularities of the surface potential of the low frequency components by driving current supplied to the beam emitting device and correcting irregularities of the surface potential of the high frequency components by pulse width modulation, to thereby form an image based on the image signal.

14. A computer-readable medium comprising a program for causing a computer to execute a method of controlling an image forming apparatus that forms an image by forming an electrostatic latent image on a photosensitive member by irradiating a beam pulse width modulated based on an image signal from a beam emitting device onto the photosensitive member, the program comprising:

a measuring module for measuring a density of an image developed from an electrostatic latent image formed by main scanning carried out on the photosensitive member by a beam having a predetermined luminous intensity;

an extracting module for extracting low frequency components and high frequency components from frequency components of irregularities of the density of the developed image; and a correcting module for correcting irregularities of the density of the low frequency components by driving current supplied to the beam emitting device and correcting irregularities of the density of the high frequency components by pulse width modulation, to thereby form an image based on the image signal.

* * * * *